US005758376A

United States Patent [19]

Meyer et al.

[11] Patent Number: 5,758,376

[45] Date of Patent: Jun. 2, 1998

[54] JIG-TYPE TEXTILE FINISHING METHOD

[75] Inventors: Bertrand Meyer, La Madeleine; Michel Colrat, Lyons; Patrick Gayrine, Ecully; Joric Marduel, Lyons; Isabelle DeVos, Avon; Françoise Lana, Vincennes, all of France

[73] Assignees: Centre Technique Industriel dit: Institut Textile de France; Electricite de France, both of France

[21] Appl. No.: 649,601

[22] PCT Filed: Sep. 29, 1995

[86] PCT No.: PCT/FR95/01273

§ 371 Date: May 24, 1996

§ 102(e) Date: May 24, 1996

[87] PCT Pub. No.: WO96/10111

PCT Pub. Date: Apr. 4, 1996

[30] Foreign Application Priority Data

Sep. 29, 1994 [FR] France ..... 94 11861

[51] Int. Cl.[6] ..... D06B 3/32

[52] U.S. Cl. ..... 8/149.1; 8/151; 68/5 C; 68/15; 68/180

[58] Field of Search ..... 8/149.1, 151; 68/5 C, 68/15, 180

[56] References Cited

FOREIGN PATENT DOCUMENTS

| | | |
|---|---|---|
| 0063203 | 10/1982 | European Pat. Off. . |
| 0065058 | 11/1982 | European Pat. Off. . |
| 2099632 | 3/1972 | France . |
| 0836251 | 6/1960 | United Kingdom . |

OTHER PUBLICATIONS

"Dye Fixation Using Radio–frequency Heating" Perkin & Catlow, JSDC vol. 100, pp. 274–280, Sep. 1984.

*Primary Examiner*—Philip R. Coe
*Attorney, Agent, or Firm*—Ladas & Parry

[57] ABSTRACT

In the jig type textile finishing method and apparatus of the invention, the textile material (19) passes through a heated treatment bath (20) and is rolled alternately in one direction and in the opposite direction with high frequency or microwave electromagnetic waves (24) being applied to said textile material (19) while it is being rolled in and/or out. The power of the waves is determined, as a function of the optimum temperature for the reaction that is to be implemented, in such a manner as to maintain the temperature of the assembly (5, 6) constituted by the rolled-in textile material and the bath in which it is impregnated substantially equal to or greater than said optimum temperature.

4 Claims, 6 Drawing Sheets

JIG-TYPE TEXTILE FINISHING METHOD

FIELD OF THE INVENTION

The present invention relates to finishing a textile by passing a given material through a treatment bath, said material being rolled up after passing through the bath, and said passage being performed alternately in one direction and in the opposite direction by successive rolling-in and -out of the material. More particularly, the present invention relates to an improved finishing method of this type and also to apparatus for implementing said method, and in particular apparatus known as jig apparatus.

All kinds of treatment can be applied to pieces of cloth in a jig, including bleaching, dyeing, and stripping, i.e. soaping cloth after it has been dyed with a reactive dye.

A jig operates by rolling out a piece of rolled-up cloth constituting a first roll, in causing it to pass through a heated treatment bath, and then in rolling it up again so as to form a second roll. Once the first roll has been fully rolled out, the travel direction is reversed so that the first roll is built up again at the expense of the second, with the cloth continuing to pass through the treatment bath. The jig has various control members for reversing the direction of rotation of the rolls, for stopping operation after a number of passes that is determined in advance, for regulating the speed of the rolls, and for regulating the tension of the cloth.

Compared with other apparatuses for finishing pieces of cloth, jigs are apparatuses having a short bath ratio, i.e. the weight of treated material relative to the volume of the impregnation bath is small, lying in the range 1 to 2. Its main advantage therefore lies mainly in savings of water and of energy.

Nevertheless, for dyeing purposes, the use of a jig is limited because of problems associated with non-uniform treatment, which can show up as variations in color, particularly at the leading and trailing ends of the pieces of cloth treated, or else in a central strip appearing in the piece. From one pass to another, such non-uniformity can also give rise to poor reproducibility of the effect obtained on the cloth, and this may apply to dyeing or to feel.

PRIOR ART

Proposals have already been made in document EP-A-0 063 203 to apply microwaves and saturated or superheated steam simultaneously in the treatment of a sheet of textile material inside a confined chamber within which said sheet is rolled up by passing alternately in one direction and then in the other, being rolled in and out in succession. According to that prior document, applying microwaves simultaneously with saturated or superheated steam has an effect of causing treatment to be uniform over the entire length and thickness of the textile material, thereby mitigating to some extent the above-specified drawbacks.

Nevertheless, in jig type industrial apparatuses, no provision is made for feeding saturated or superheated steam. As a result, the teaching of document EP-A-0 063 203 requires additional means to be implemented and that is hardly practical on equipment already in existence, and it may give rise to condensation phenomena.

According to the Applicants, the use of a jig is not optimum with respect to treatment kinetics: according to their observations, this would appear to be due to a drop in temperature suffered by the cloth between leaving the treatment bath and being rolled up, which drop in temperature is caused by the cloth passing from the bath at a given temperature through air that is at a lower temperature.

SUBJECT MATTER AND SUMMARY OF THE INVENTION

The object of the Applicants is to provide an improved method that achieves better treatment kinetics in a textile finishing apparatus of the jig type.

This object is fully achieved by the method of the invention. In manner known from document EP-A-0 063 203, the method is a textile finishing method in which the textile material passes through a heated treatment bath and is rolled alternately in one direction and in the other while electromagnetic waves are applied to said textile material as it is being rolled in and/or out.

In characteristic manner, the power of the electromagnetic waves is determined as a function of the optimum temperature for the reaction implemented, in such a manner as to maintain the temperature of the assembly constituted by the rolled-in textile material and the bath in which it is impregnated at a value that is equal to or greater than said optimum temperature.

The Applicants have been able to verify that the action of electromagnetic waves on the textile material as impregnated in the hot treatment bath makes it possible to obtain and to maintain the temperature which is optimum for the reaction within the roll, which optimum temperature enhances the physico-chemical reaction implemented during said treatment. The Applicants have been able to observe that such temperature optimization within the roll reduces or even eliminates the non-uniformities that used to appear in the past when electromagnetic waves were not applied. The Applicants have also been able to establish that the method of the invention presents additional advantages. A first advantage consists in reducing the treatment time required for obtaining a given effect, e.g. to obtain the same degree of whiteness while bleaching or the same final shade while dyeing. A second advantage consists in the possibility of improving the effect obtained, for example obtaining a greater degree of whiteness while bleaching, or a stronger final shade while dyeing, or greater dye elimination while soaping. Other advantages stem from the above, in particular the possibility of reducing the concentration of a dye bath in order to obtain a given final shade, increasing productivity, . . . .

During treatment, the optimum temperature for the reaction implemented corresponds substantially to the temperature of the treatment bath as recommended by the manufacturers of the chemical reagents. The power of the electromagnetic waves must thus be such that the action they generate on the textile material consists in maintaining the temperature of the assembly constituted by the rolled-up piece of cloth and the bath in which it is impregnated at a value substantially equal to or greater than said optimum temperature.

It should nevertheless be observed that too much power gives rise to harmful overheating that can cause possible migration of the reagents, and in particular of dyes when dyeing is being performed.

The power of the electromagnetic waves is naturally proportional to the quantity of material being treated, i.e. to the textile material proper, to the bath in which it is impregnated, and also to the travel speed of the material.

According to the Applicants, the appropriate power (P) of the electromagnetic wave can be given by the following equation:

$$P=(5.434m\Delta T)\times r^{-1}$$

in which P is the power in kW, m is the mass of the piece in kg, $\Delta T$ is the temperature difference to be compensated in °C. (generally about 15° C.) between the desired temperature which is equal to or greater than the optimum temperature and the real temperature of the material in the roll, assuming that electromagnetic waves are not being applied, and t is the mean time required for rolling up during one pass.

In a first variant implementation of the invention, electromagnetic waves are applied simultaneously to both rolls, i.e. to the textile material both while it is being rolled out and while it is being rolled in.

In a second variant implementation, electromagnetic waves are applied only to the roll which is being rolled in.

Given that the looked-for effect is mainly a thermal effect within the material, the electromagnetic waves themselves may be microwaves or high frequency waves, in industrial frequency ranges.

Another object of the invention is to provide improved apparatus specifically designed for implementing the above-specified method.

The invention thus provides jig type textile finishing apparatus that includes an enclosure containing a both-way system for rolling in and out, a trough for an impregnating bath, and a feeder system enabling the moving plane textile material to dip into the bath. The apparatus also includes electromagnetic wave applicator means suitable for applying said waves to the plane textile material while it is being rolled in and/or out.

The electromagnetic wave applicator means comprise at least one generator and at least one waveguide connected to said generator, and they apply the electromagnetic waves inside the enclosure, facing the location of a roll such that said transmitted waves are directed towards the roll and across the entire width thereof.

The applicator may be a waveguide that has slots or radiating antennas, and that extends across the full width of the roll.

The applicator may comprise a plurality of juxtaposed open-ended waveguides in alignment so that the radiated electromagnetic waves cover the entire width of the roll. For example, it may be constituted by waveguides each connected to a respective low power generator.

The waves penetrate to a shallow depth (about 1 cm) in a continuous zone that extends across the entire width of the roll. Power is determined so as to make up the temperature difference otherwise caused by the material passing through air as it moves.

Advantageously, each waveguide is fitted with a focusing and/or matching extension enabling electromagnetic waves to be directed towards the roll, and thus achieving even more localized wave absorption by said roll.

Advantageously, the apparatus includes generator control means suitable for actuating the electromagnetic waves as a function of the width of the textile material. It is thus possible to operate only those waveguides that open out facing the roll, thereby optimizing power consumption.

Also, and preferably, the apparatus includes an electronic control circuit which is connected to the rolling-in/out system and to the means for applying electromagnetic waves, and in particular the generator means; said circuit is programmed so as to control the travel speed of the textile material in such a manner as to maintain electromagnetic wave power at its maximum. In this particular disposition, the apparatus is driven automatically in such a way as to vary the drive speed of the rolling-in and -out system to comply with maximum power from the generators. The drive speed is selected to be the maximum for given generator power so as to reduce treatment time, in application of the following equation:

$$V=P\times L/5.434\times m\times \Delta T$$

in which L is the length of the material to be treated and V is its travel speed.

Preferably, and in all embodiments, the apparatus includes at least two waveguides having slots or antennas or two sets of open-ended waveguides in alignment suitable for transmitting the corresponding electromagnetic waves over the entire width of each of the two rolls, with each waveguide being fed by a respective generator; in addition, the apparatus includes generator control means suitable for controlling and regulating the power of the transmitted waves as a function of the displacement direction of the textile material.

In order to avoid radiation leaking out from the enclosure, the apparatus advantageously includes wave traps mounted on the shafts of the two rolls, on access hatches to the enclosure, and on any moving member that passes out from the enclosure. In particular, the wave traps may be quarter-wave traps. The traps are preferably filled with and/or associated with a dielectric that does not absorb the waves, and that serves simultaneously to trap waves and to provide liquid sealing.

It will be understood that the action of the electromagnetic waves on the textile material being rolled in and/or out is not intended to heat the impregnating bath, but to maintain the optimum temperature of the impregnated textile material coming from said bath while it is in one or other of the rolls, during the rolling-in and/or -out stages. In order to prevent the electromagnetic waves that propagate in the enclosure interfering with heating of the bath proper, it is advantageous for the apparatus to include bath protection means, suitable for preventing the electromagnetic waves propagating into said bath. Such means may be constituted, for example, by an optionally perforated plate mounted over the trough above the level of the bath and made of a material that is impermeable to electromagnetic waves, in particular a non-magnetic metal.

BRIEF DESCRIPTION OF THE DRAWINGS

The present invention will be better understood on reading the following description of an embodiment of a jig including microwave applicator means, and of various examples of how such a jig can be used, illustrated by the accompanying drawings, in which.

MORE DETAILED DESCRIPTION

Traditionally, a jig is an apparatus which includes a device for open-width rolling in and out of pieces of cloth in both directions of rotation, an impregnating trough, and a feeder system enabling the moving piece of cloth to be dipped in the bath contained in the trough.

Figure 1:
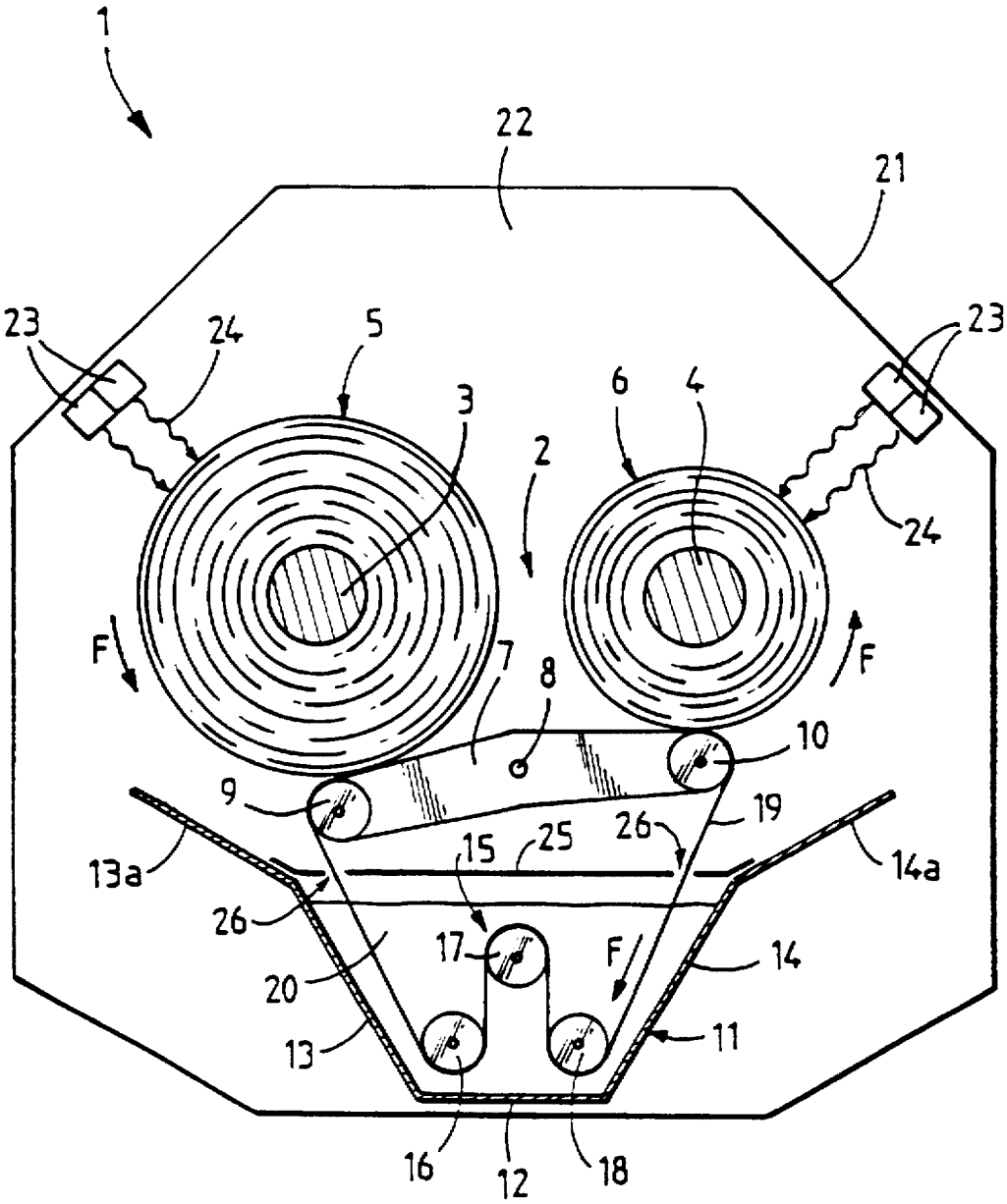
FIG. 1 is a diagram of the jig of the invention.

These three elements are shown in FIG. 1 which is a diagram of the jig 1 of the invention. The device 2 for rolling cloth in and out comprises two shafts 3 and 4 on which respective rolls 5 and 6 of the piece of cloth are disposed. These shafts are rotated in coordinated manner by means that are not shown. The device 2 also comprises a rocker 7 that is movable about an axis 8, the rocker 7 carrying respective presser wheel 9, 10 at each of its ends.

The axes of rotation of the two shafts 3, 4, of the presser wheels 9, 10 and the axis 8 of the rocker 7 are all mutually parallel.

The trough 11 is disposed beneath the shafts 3 and 4. In the example shown, its section is in the form of an isosceles trapezium, having a small base corresponding to the bottom 12 of the trough 11 and two sides corresponding to the lateral flanks 13 and 14 thereof.

The top portions of the two lateral flanks 13 and 14 are flared outwardly by respective extensions 13*a* and 14*a* designed to extend beyond the rolls 5 and 6.

The feeder system 15 comprises three rollers 16, 17, and 18 which are mounted inside the trough 11 and whose axes extend in the same direction as the shafts 3 and 4. As can be seen clearly in FIG. 1, two of the feeder rollers 16 and 18 are located close to the bottom 12 of the trough 11 while the third roller 17 is disposed above the other two 16 and 18.

The path followed by a piece of cloth is represented in FIG. 1 by arrows F. This relates to rolling the first roll 5 in from the second roll 6.

The shaft 4 rotates the second roll 6 in the direction of arrow F; the cloth 19 coming from said second roll 6 passes over the presser wheel 10, dips into the impregnating bath 20 contained in the trough 11, passes through the feeder system 15 passing respectively over the roller 18 near the bottom 12 of the trough 11, then over the roller 17, and finally over the roller 16; the impregnated cloth 19 passes over the presser wheel 9 and is rolled in to form the first roll 5 around the shaft 3.

In conventional manner, the jig 1 includes means for heating and regulating the impregnating bath 20, means for monitoring the depth of the bath in the trough 11, and an associated bath feed circuit.

Once the piece of cloth 19 has passed fully onto the first roll 5, the device 2 for rolling cloth in and out is reversed so that the shafts 3 and 4 rotate in the opposite direction. The rocker 7 is adjusted so as to keep the presser wheels 9 and 10 pressing with constant force against the outside surface of the two rolls 5 and 6 so as to avoid any creasing and so as to obtain constant tension.

The drive means for the shafts 3 and 4 are also regulated in speed so as to accommodate the relative increase in diameter of the rolls 5 and 6 in order to ensure that the speed at which the cloth 19 moves through the bath 20 remains constant.

In accordance with the invention, the jig is provided with means for applying electromagnetic waves to the cloth 19 while it is being rolled in or out.

In the example described, these are industrial type microwaves, i.e. at approved frequencies, namely 2,450 MHz, 915 MHz, 433 MHz. It is also possible to use industrial type high frequency waves at the following frequencies: 13.56 MHz; 27.12 MHz; 40.68 MHz.

The rolling in and out device 2, the trough 11, and the feeder system 15 are placed inside an enclosure 21 which defines a space 22 around these various elements 2, 11, and 15, which space must be capable of being isolated from the premises proper in which the jig 1 is located.

In the example shown, microwaves are applied by means of radiating slotted waveguides 23, or optionally by means of antennas. These radiating waveguides 23 extend along the entire width of the cloth, there being four of them in the example shown, and they are located inside the enclosure 21 close to the shafts 3 and 4 so that the microwaves coming from the radiating waveguides 23 are preferentially directed towards the outside surface of the cloth 19 making up the rolls 5 and 6, and over the entire width thereof. The preferential direction of the microwaves emitted by the four waveguides is represented in FIG. 1 in the form of wavy lines 24, two of the waveguides being situated facing the first roll 5 and the other two facing the second roll 6.

The radiating waveguides 23 are powered by microwave generators (not shown), which generators are themselves connected to the control means of the jig 1. A plate 25 made of a microwave reflecting material is disposed in the trough 11 above the level of the impregnating bath 20. The main function of the plate is to prevent the microwaves 24 giving rise to localized heating of the bath 20 since that would disturb proper operation of the temperature regulator means of the jig 1. The plate 25 is naturally provided with slots 26 through which the cloth 19 passes. It may optionally be perforated to facilitate the flow of steam coming from the bath 20 and also so that while the cloth 19 is being rolled in, it is easier for excess bath liquid running off the cloth 19 to run back into the trough 11.

In the specific example of making a small jig 1, suitable for treating pieces of cloth 19 that are 40 cm wide, the jig 1 was fitted with two microwave generators each having a power of 1.2 kW and each suitable for feeding two radiating waveguides 23.

The trough 11 contained four liters of impregnating bath 20, adjustable by means of a feed circuit having a capacity of 20 liters. This laboratory jig enabled tests to be performed on a capacity of two kilos of material with bath ratios lying in the range 1:2 to 1:10.

Figure 9:
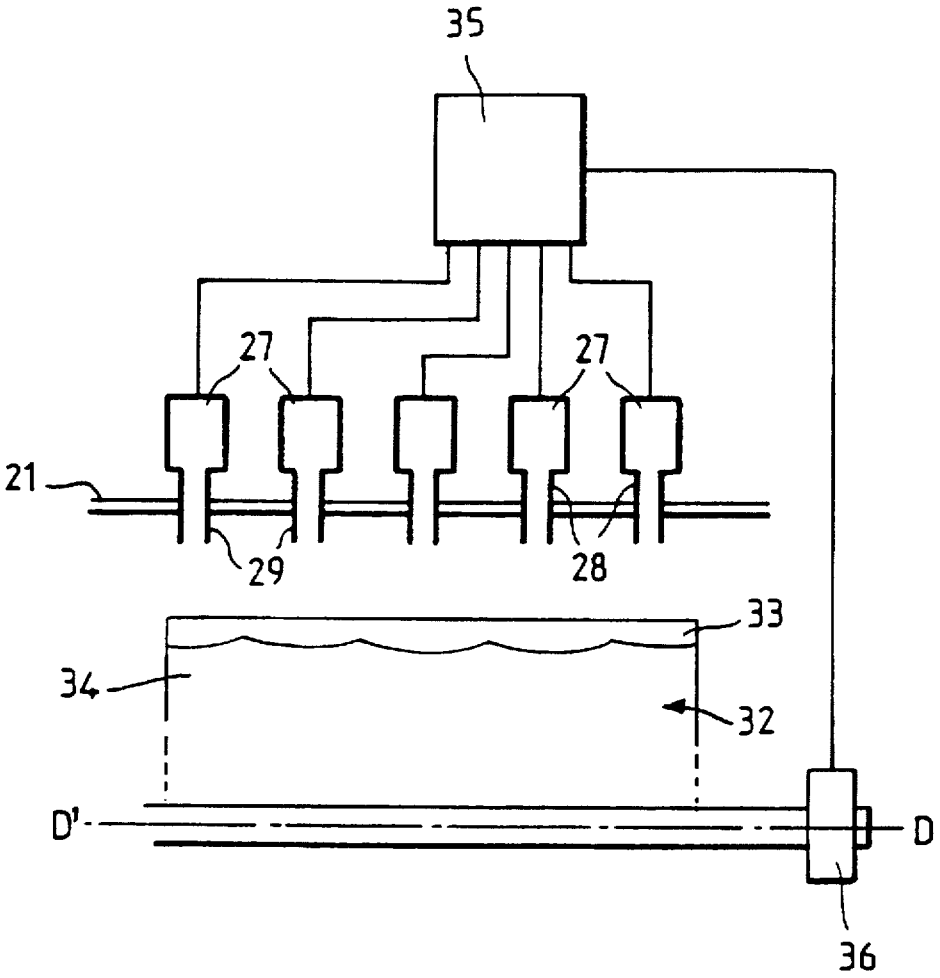
FIG. 9 is a fragmentary diagrammatic section through the jig of the invention.

In the example shown in FIG. 9, microwaves were applied by means of a battery of generators, each generator being connected to a waveguide 28 opening out into the inside of the enclosure 21. Each waveguide 28 is preferably fitted with an extension 29 inside the enclosure 21 and suitable for matching and/or focusing the wave on the roll.

The extensions 29 are disposed substantially vertically above the axis D-D' of rotation of the roll. The extensions 29 are aligned as shown in FIG. 9 so that the radiated electromagnetic waves are distributed at the surface of the roll 32 through a thickness of about 1 cm and across the entire width of said roll 32. Thus, at any given instant, the action of the microwaves on the roll 32 is concentrated in a zone 33 of narrow width, of length equal to the width of the roll, and of small thickness of about 1 cm. The zone 33 includes not only the textile material under treatment, but also treatment bath that has been carried away by said material after passing through the trough. The effect of the microwaves is to heat the zone 33 so as to compensate the loss of temperature due to the material passing through air while running at relatively high speed. The temperature drop is generally estimated to be about 10° C. to about 15° C. Given that the microwaves act while the roll is being rotated, a hot zone 33 is established over the entire periphery of the roll through a small thickness, it being understood that the zone is renewed by successive new layers of textile material during rolling in. In addition, the surface zone 33 which is continuously heated by the action of the microwaves prevents heat being lost from the core 34 of the roll 32. It can thus be considered that the entire roll 32 constituted by the textile material to be treated and the treatment bath impregnating it is constantly maintained at the optimum reaction temperature for the intended treatment. Under such conditions, optimum kinetics are obtained for the treatment.

In order also to optimize energy consumption, each generator 29 is controlled by an electronic circuit 35 which is programmed so that only those waveguide generators facing the roll are put into operation. Thus, when treating pieces of cloth of width smaller than the maximum dimension of the apparatus, energy consumption is reduced.

In order also to optimize treatment time, and working on the principle that an apparatus is fitted with a battery of generators of given power, the operation of the jig is automatically controlled to vary the travel speed of the textile material so as to maintain the generators 27 at maximum power. For this purpose, the electronic circuit 35 is connected to the motor 36 for rolling in and out. The electronic circuit 35 is programmed to determine the travel speed V as a function of parameters specific to the textile material. Certain parameters are input to the electronic circuit by the operator, in particular the width and the length of the piece and the nature of the corresponding textile material. Other parameters are evaluated by experiment and programmed into the electronic circuit 35, in particular the mean carry-off rate due to the nature of the textile material, and the temperature difference $\Delta T$ for a given type of apparatus.

The travel speed V is thus selected to be at a maximum so as to reduce treatment time for given maximum available microwave power, thereby enabling temperature correction to be obtained in as short a time as possible, in application of the following equation:

$$V=P.L/4.18\times1.3\times m\times\Delta T$$

In the method of the invention, the electromagnetic waves act mainly as additional energy suppliers to heat the textile material more easily and, as explained above, to maintain the optimum temperature within the roll.

In the examples described below, the positive effects of applying microwaves were demonstrated firstly by regularly and systematically taking samples of the treated material while it was being treated, and analyzing said samples, and secondly by systematically taking samples from the bath and analyzing them, in particular by spectrocolorimetry.

FIRST EXAMPLE

Bleaching cotton.

Cotton is bleached by oxidizing the colored compounds that are naturally contained in the fiber. This was done by using oxygenated water as the reagent and operating for 1 hour at 98° C.

Figure 2:
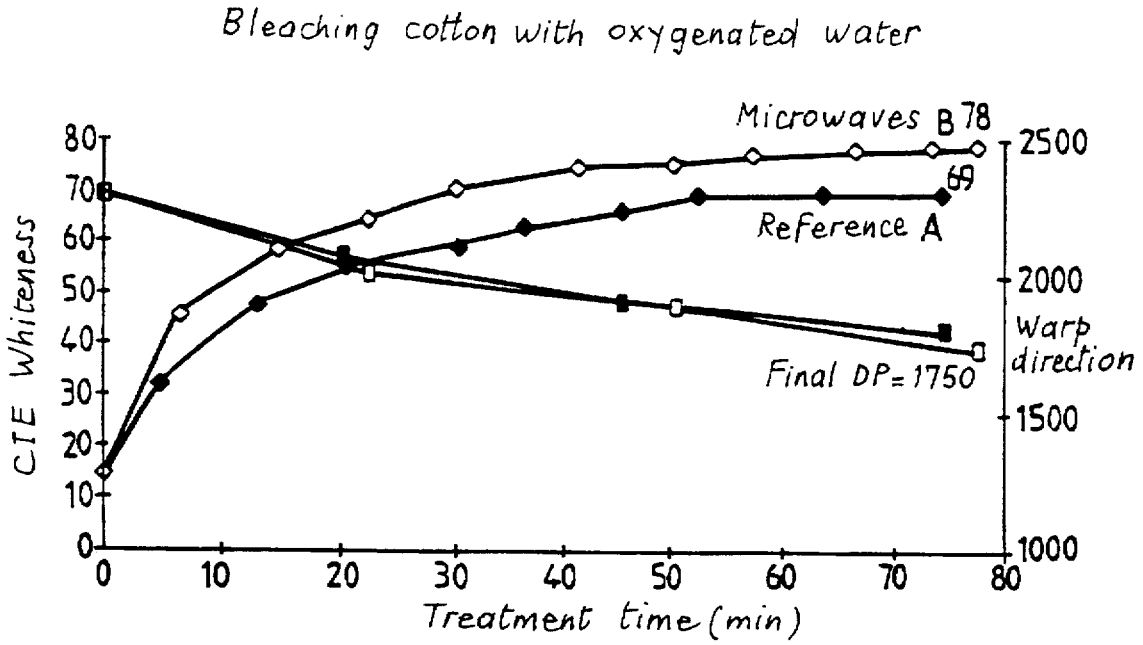
FIG. 2 is a graph showing how the degree of whiteness varies when bleaching cotton.
Figure 3:
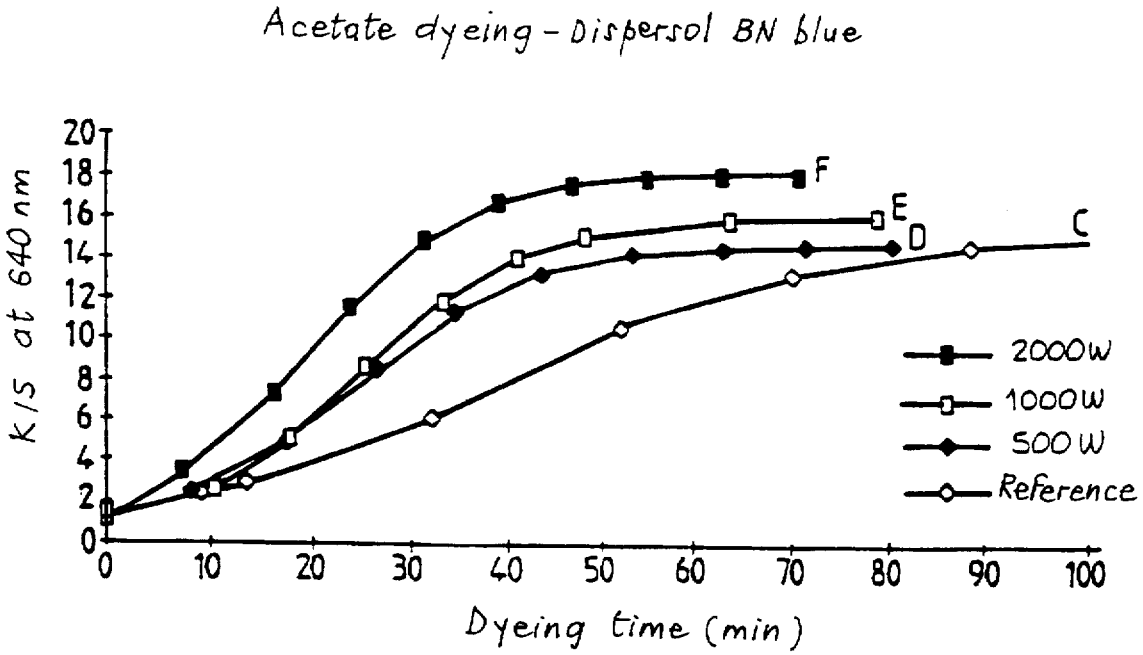
FIGS. 3 and 4 are graphs showing the kinetics of dyeing when performing acetate dyeing.

FIG. 2 is a graph showing how the degree of whiteness as measured by the CIE whiteness coefficient varied as a function of treatment time.

Variation in the degree of polymerization (DP) is also plotted on the same graph.

Curve A represents the kinetics of bleaching a reference cotton cloth while curve B shows the kinetics relating to treatment under the same conditions but with application of microwaves at a power of 2000 W throughout the entire duration of the treatment.

It can be seen that the treatment time required for obtaining a given degree of whiteness was reduced by 50% by applying microwaves in accordance with the method of the invention. Also, the degree of whiteness obtained at the end of treatment was nearly 20% better when microwaves were applied.

In addition, no deterioration appeared due to using microwaves, with the degree of polymerization remaining unchanged relative to conventional treatment.

It can be seen from this test that the method using electromagnetic waves appears to make better use of the oxidizing potential of the formulation used. If the degree of whiteness is not of prime importance, e.g. when making preparations for dyeing, it is possible to reduce treatment time and also the quantities of chemicals used, oxygenated water or soda. Under such circumstances, it should be possible to obtain a reduction in the degree of polymerization that is smaller than with the conventional method.

SECOND EXAMPLE

Acetate dyeing.

The kinetics of dyeing were evaluated by varying the microwave power applied to the generators over a range of 500 W to 2000 W.

In the curves relating to the kinetics of dyeing, obtained in the present example and in the following examples, the absorption coefficient K/S relating to the wavelength corresponding to the selected color is plotted up the ordinate. For example, for a blue, the absorption coefficient was measured at 640 nm. The results that can be observed on examining these curves all show much the same phenomenon, namely that the kinetics of dyeing is accelerated as a function of the amount of extra microwave energy applied, and that the final shade strength obtained after applying microwaves is greater. The finisher can thus opt either to increase the productivity of an installation or else to improve the quality of the treatment.

With acetate dyeing using dispersal BN blue dye, comparative tests were performed using a reference cloth without microwaves (curve C), and with three different microwave powers: 500 W (curve D), 1000 W (curve E), and 2000 W (curve F).

By comparing the four curves, it can be seen that for a dye bath having the same concentration, specifically 3% in the present case, acceleration of the kinetics of dyeing is a function of the applied microwave power.

The final shade of the reference was reached after a time that was 50% shorter when microwaves were applied at 1000 W; the time was even shorter when 2000 W were applied.

Figure 4:
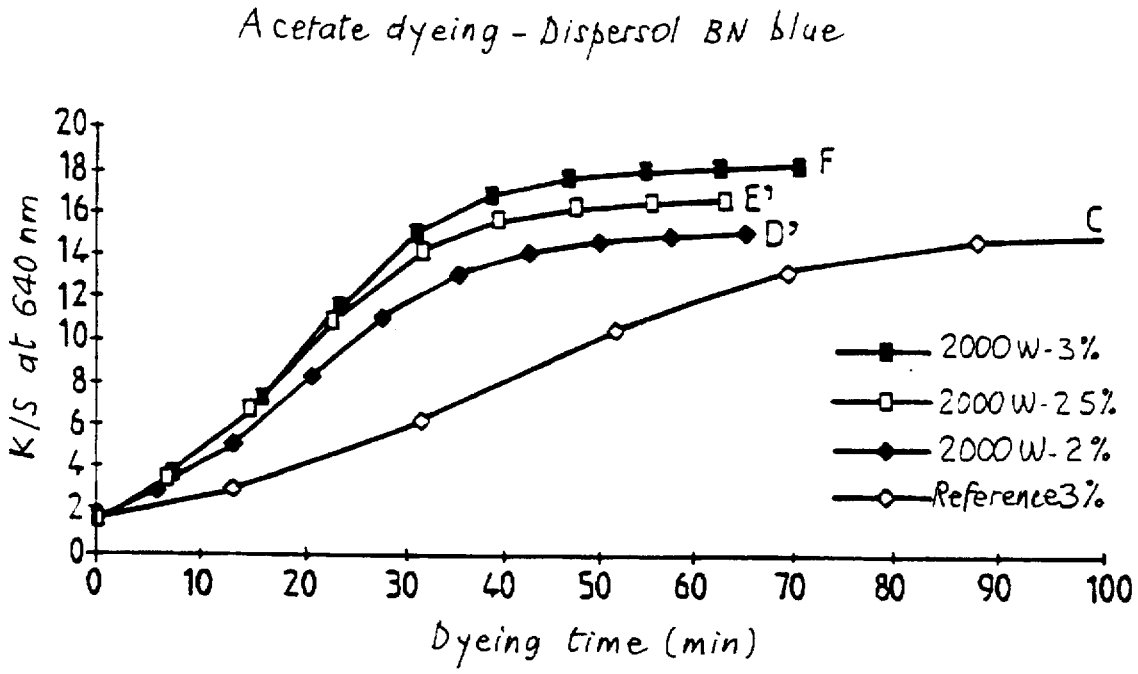

In addition, it can be seen that when microwaves are applied, the final shade is considerably stronger than with the reference, when using the same formulation. This effect has been verified by the Applicants by performing comparative dyeing operations with microwaves in which the baths were at lower concentrations of dye compared with the reference. The results are given in FIG. 4 which relates to a dispersol BN blue acetate dye as before, but in which curves D' and E' relate respectively to dyeing with baths having 2% and 2.5% dye and with a microwave power of 2000 W.

It can thus clearly be seen that implementing the method of the invention makes it possible to reduce the amount of dye required to obtain a given shade by about one-third. This reduction in the amount of dye has no effect on the acceleration of the kinetics of the treatment.

In all cases, color fastness on washing remained unchanged.

Acetate dyeing is performed with dispersed dye that is diffused in the fiber by wetting and dispersing agents at a temperature of about 80° C. to about 85° C.

THIRD EXAMPLE

Dyeing cotton

Dyeing was performed using a high-temperature reactive dye, which constitutes the class of dye that is most widely used at present. The operating conditions were conventional for jig dyeing: the cloth was wetted in a dye-free bath at 40° C., dye and salt were added, the temperature was raised to 80° C., carbonate was added, and fixation was performed for one hour.

Figure 5:
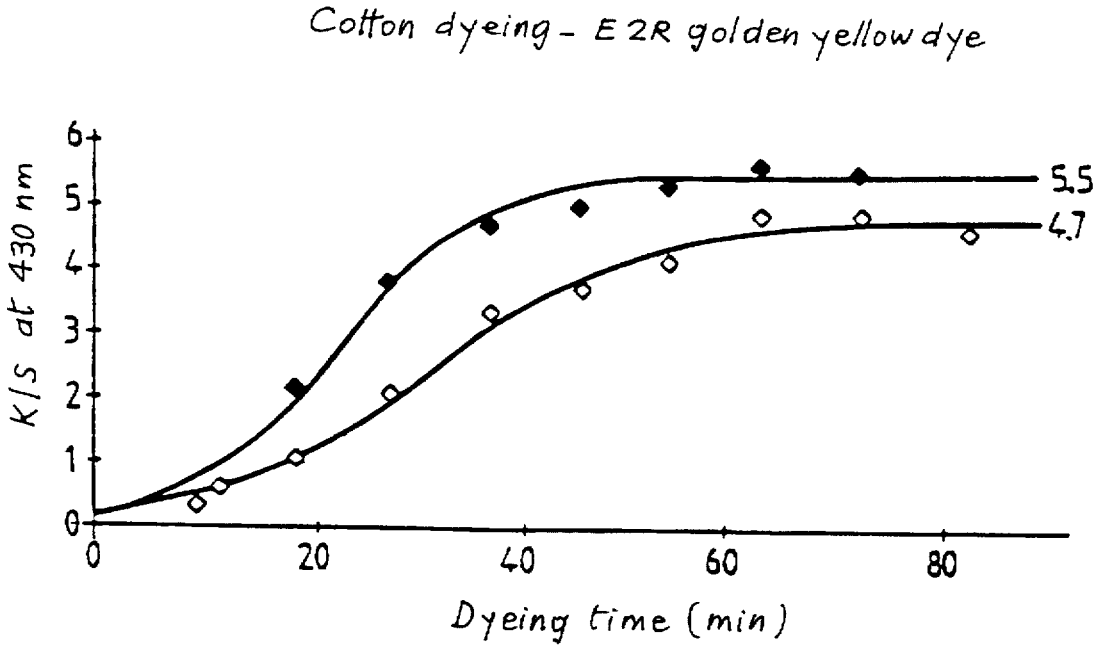
FIG. 5 is a graph showing the kinetics of dyeing when dyeing cotton.

FIG. 5 shows the kinetics of dye fixation on cotton cloth. It shows that the kinetics were accelerated and that the shade obtained at the end of dyeing was stronger. The K/S absorption coefficient was measured at a wavelength of 430 nm for an E2R golden yellow dye. At the end of dyeing, the coefficient was 4.7 for the reference and 5.5 for the cloth dyed with microwaves being applied at a power of 2000 W.

The Applicants have also been able to verify that the action of microwaves has no effect on the substantive nature of the dye relative to cotton. By measuring the concentration of dye remaining in the dyeing bath as from the addition of carbonate, they observed that the concentration was identical whether or not microwaves were applied. In conclusion, it can be seen that the action of microwaves has an effect on fixation of the dye, but not on its substantive nature relative to cotton.

Figure 6:
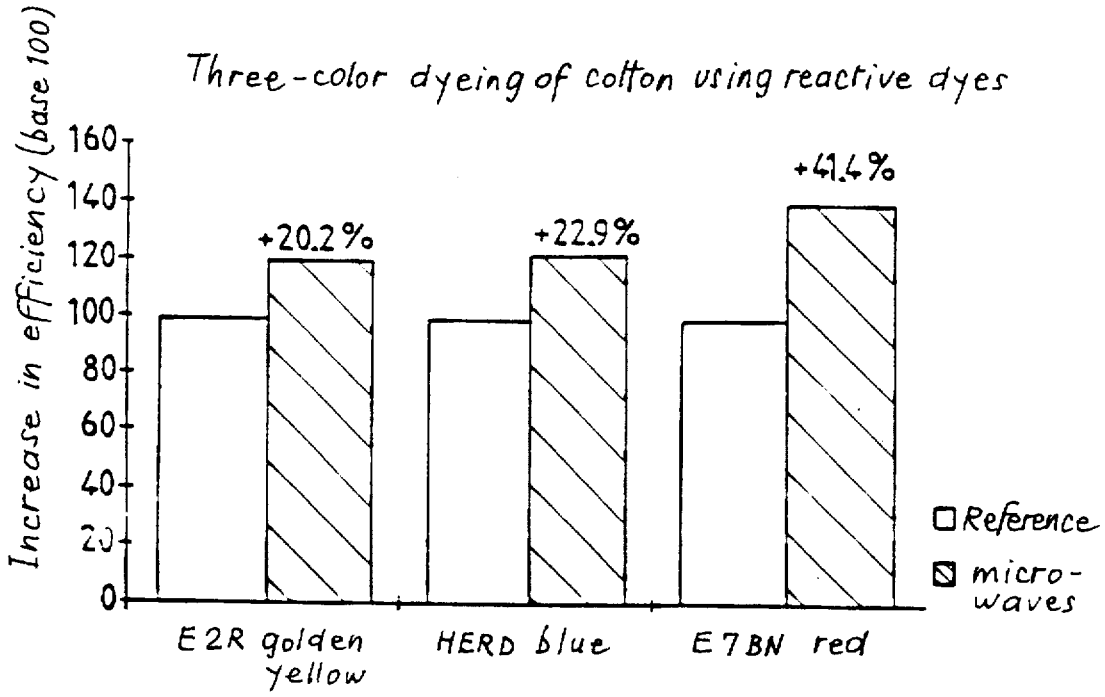
FIG. 6 shows the change in dyeing efficiency for three-color dyeing of cotton.

Additional testing has shown that interaction exists between various dyes of the same type and the influence of microwave action. These tests are illustrated by FIG. 6 which shows the increase in dyeing efficiency obtained by applying microwaves in accordance with the method of the invention in the context of three-color dyeing using reactive dyes. Color efficiencies were evaluated by performing colorimetry on the dyed cloth. The dyes used for the three-color dyeing were respectively E2R golden yellow, HERD blue, and E7BN red. The dyeing efficiency of each dye is plotted up the ordinate in FIG. 6, relative to a base of 100 representing the dyeing efficiency of the reference. It can be seen that dyeing efficiency is increased by about 20% for yellow and blue, and by about 40% for red.

FOURTH EXAMPLE

Polyamide dyeing

Polyamide dyeing is performed using an acid dye; the bath is controlled both in pH and in temperature which is about 100° C., in order to ensure optimum conditions for the reaction. A difficulty with polyamide dyeing is using up the dye bath appropriately. The darker the tone to be dyed, the more difficult it is to use up the dye completely. In the present example, a dye bath having a concentration of 4% acidol M-SRL black dye was selected so as to increase the potential improvement of dyeing efficiency expected of the dyeing method of the invention. In addition, application of microwaves was voluntarily delayed for about 10 minutes from the beginning of dyeing, so as to have a reliable point of comparison between the reference and dyeing in accordance with the invention.

Figure 7:
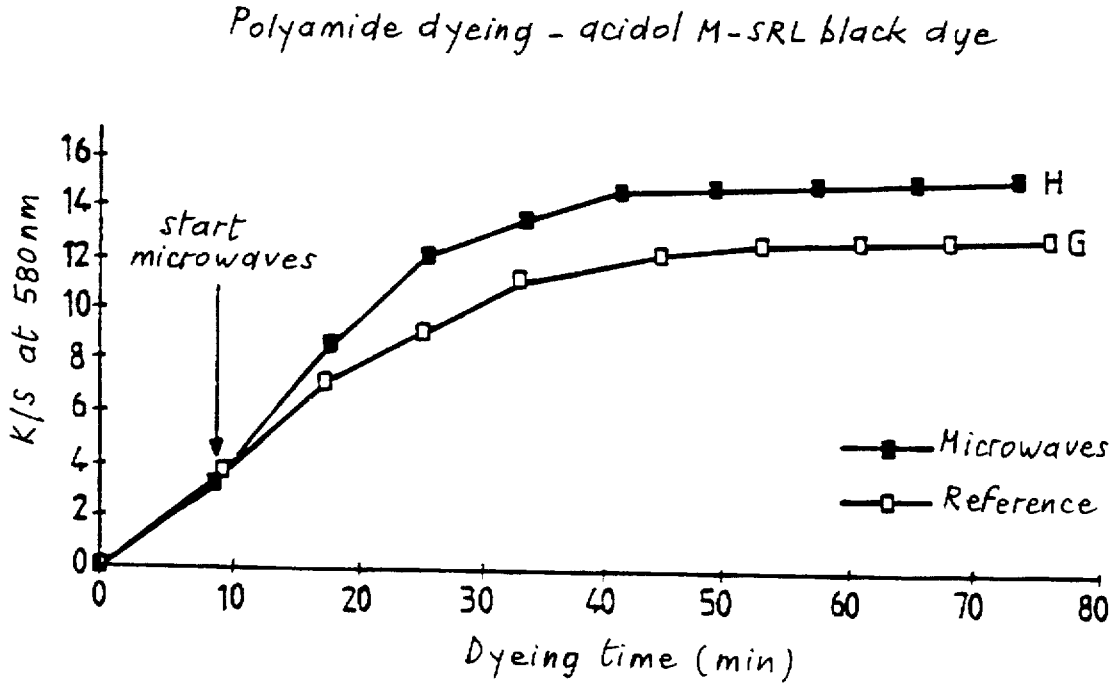
FIG. 7 is a graph showing the kinetics of dyeing for a polyamide dye.

With reference to FIG. 7, comparing curve G which corresponds to the reference and curve H which corresponds to polyamide cloth dyed with microwaves being applied demonstrates the same effects as before, namely that the kinetics of dyeing are accelerated and the shade finally obtained is increased, even though the action of microwaves was delayed.

FIFTH EXAMPLE

Soaping cotton

After dyeing, cotton soaping consists in eliminating dye that is not fixed to the fiber. This is done by rinsing in very hot water at 100° C., enabling a good exchange of dye to take place between the material and the bath. In the present case, soaping was performed after conventional dyeing, i.e. not after dyeing performed while applying microwaves.

To keep track of the soaping, the concentration of dye in the soaping bath containing the protective colloid was measured continuously. As before, the application of microwaves was delayed in order to monitor correspondence between the reference treatment and the treatment including application of microwaves. The duration of the soaping was deliberately extended in order to verify that the washing bath had become saturated, i.e. that all of the non-fixed dye had been eliminated.

Figure 8:
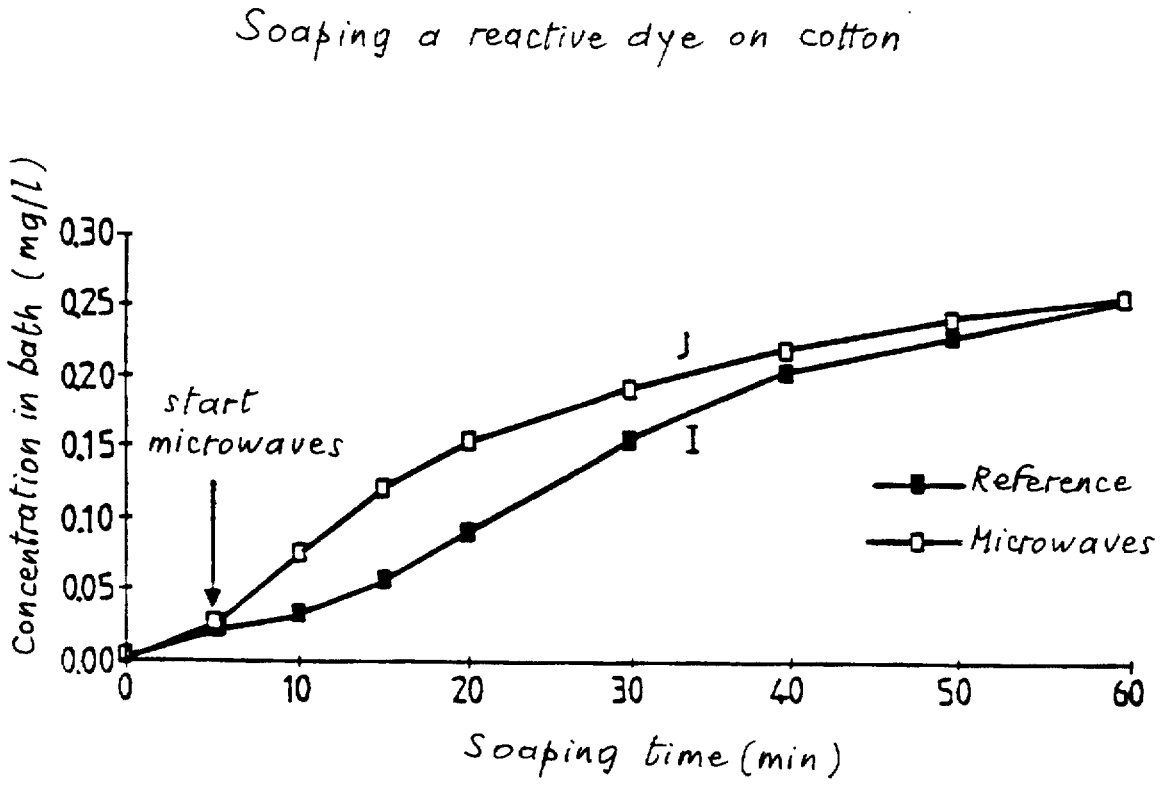
FIG. 8 is a graph showing the kinetics of soaping for finishing cotton that has been dyed with reactive dyes.

In FIG. 8, there are plotted a curve I relating to the reference and a curve J relating to soaping in conjunction with microwave application.

Examination of the curves shows that the action of microwaves is particularly effective at the beginning of treatment. After a period of about 30 minutes, which is the usual duration of soaping, it can be seen that the action of microwaves has made it possible to eliminate one-third more dye, reducing the quantity of non-fixed dye remaining to be eliminated in final rinsing from 40% to 20%.

The application of microwaves thus makes it possible to reduce rinsing and to generate less effluent.

The present invention is not limited to the embodiments described above relating to implementation of the method, nor it is limited to the specific description given of the jig. In particular, the application of electromagnetic waves, whether microwaves or high frequencies, can take place either solely on the roll which is being built up, i.e. the first roll 5 in the example shown, or else on both rolls whether they are rolling in or rolling out. In the first case, the control circuit which enables the direction of rotation of the shafts 3 and 4 to be reversed automatically also triggers successive actuation of the generators corresponding to the waveguide (s) disposed facing the roll which is rolling in. Otherwise, in the second case, all of the generators are constantly in operation.

The Applicants have also observed that there is no significant difference between these two operating variants and that what matters is mainly the total power of electromagnetic waves applied to the textile material.

It should also be observed that the method of the invention makes it possible to reduce or even eliminate non-uniformities in dyeing between the beginning and the end of a piece of material and between the two selvedges, which defects are due to losses and to temperature non-uniformities across the material. The action of the microwaves thus also serves to obtain better dyeing reproducibility and more generally better reproducibility of any treatment applied by means of a jig.

Furthermore, applying microwaves in accordance with the present invention can be done in a combination jig type apparatus where treatment is performed at a temperature of more than 100° C. and under pressure, e.g. for treating polyester.

We claim:

1. A textile finishing method implementing, on a textile material, a reaction having an optimum temperature, in which the textile material passes through a heated treatment bath and is rolled alternately in one direction and in the other, with electromagnetic waves being applied to said textile material while it is being rolled in and/or rolled out and directed toward the rolled textile material over the entire width thereof, wherein the power of the electromagnetic waves is determined as a function of said optimum temperature of the reaction in such a manner as to maintain the temperature of the assembly constituted by the rolled textile material and the bath in which it is impregnated substantially equal to or greater than said optimum temperature.

2. A method according to claim 1, wherein the power of the electromagnetic waves is given approximately by the following equation:

$$[P=xt^{-1}]P=(5.434\cdot m\cdot \Delta T)\cdot t^{-1}$$

where P is the power in kW, m is the mass in kg of the textile material being treated, ΔT is the temperature difference in ° C. between the desired temperature which is equal to or greater than the optimum temperature and the real temperature of the rolled textile material without electromagnetic waves being applied, and t is the mean rolling-in time, in seconds, for the textile material passing the heated treatment bath once.

3. A method according to claim 1 wherein for a given power P, the travel speed V of the material is caused to vary in application of the following formula: $V=P\cdot L/5.434m\Delta T$, where L is the length of material to be treated, m is the mass in kg of the textile material being treated, ΔT is the temperature difference in ° C. between the desired temperature which is equal to or greater than the optimum temperature and the real temperature of the rolled textile material without electromagnetic waves.

4. A method according to claim 1 wherein, the electromagnetic waves are applied solely to the textile material while it is being rolled in.

* * * * *